US010765213B2

(12) United States Patent
Pernet et al.

(10) Patent No.: US 10,765,213 B2
(45) Date of Patent: Sep. 8, 2020

(54) RECLINABLE FOLDING DECKCHAIR

(71) Applicant: LAFUMA MOBILIER SAS, Anneyron (FR)

(72) Inventors: Jean-Noël Pernet, Condamine La Doye (FR); Corrado Roani, Manthes (FR)

(73) Assignee: LAFUMA MOBILIER SAS, Anneyron (FR)

( * ) Notice: Subject to any disclaimer, the term of this patent is extended or adjusted under 35 U.S.C. 154(b) by 0 days.

(21) Appl. No.: 16/349,088

(22) PCT Filed: Nov. 8, 2017

(86) PCT No.: PCT/FR2017/053042

§ 371 (c)(1),
(2) Date: May 10, 2019

(87) PCT Pub. No.: WO2018/087468

PCT Pub. Date: May 17, 2018

(65) Prior Publication Data

US 2019/0269244 A1 Sep. 5, 2019

(30) Foreign Application Priority Data

Nov. 10, 2016 (FR) ..... 16 60899

(51) Int. Cl.
*A47C 4/00* (2006.01)
*A47C 1/14* (2006.01)
(Continued)

(52) U.S. Cl.
CPC ..... *A47C 1/0355* (2013.01); *A47C 1/0352* (2013.01); *A47C 1/14* (2013.01); *A47C 4/04* (2013.01); *A47C 4/22* (2013.01)

(58) Field of Classification Search
CPC .... A47C 4/04; A47C 4/00; A47C 1/14; A47C 1/035; A47C 4/22; A47C 4/46; A45F 2004/026
See application file for complete search history.

(56) References Cited

U.S. PATENT DOCUMENTS 6,471,287 B1 * 10/2002 Liu ..... A47C 3/029 297/32
7,063,380 B1 * 6/2006 Cui ..... A47C 1/035 297/25

(Continued)

FOREIGN PATENT DOCUMENTS

FR 2721811 A1 1/1996

OTHER PUBLICATIONS

International Search Report dated Jan. 29, 2018 re: Application No. PCT/FR2017/053042, pp. 1-2, US 2012/286544 A1, US 2002/125745 A1, US 2009/072592 A1 and FR 2 721 811 A1.

*Primary Examiner* — Shin H Kim
(74) *Attorney, Agent, or Firm* — Cantor Colburn LLP

(57) ABSTRACT

A reclinable and folding deckchair including: —a backrest, —a seating portion, —an underframe, formed of a first leg assembly and the second leg assembly, each leg assembly being formed of at least a first front leg and of a second rear leg, where the leg assembly yoke is formed of at least one receiving shell including a first housing configured to accept a fixing member, at least partially, the fixing member being intended to be fixed to a seating portion longitudinal member, and at least one cover shell, articulated with respect to the receiving shell, the said cover shell having, on one face, a cover configured to at least partially conceal the fixing member housed at least in part in the first housing of the receiving shell.

11 Claims, 7 Drawing Sheets

(51) Int. Cl.

| | |
|---|---|
| ***A47C 4/04*** | (2006.01) |
| ***A47C 1/0355*** | (2013.01) |
| ***A47C 1/035*** | (2006.01) |
| ***A47C 4/22*** | (2006.01) |

(56) References Cited

U.S. PATENT DOCUMENTS

| | | | | |
|---|---|---|---|---|
| 7,628,450 | B2 * | 12/2009 | Castagnola | A47C 4/42 297/16.1 |
| 7,950,734 | B2 * | 5/2011 | Zheng | A47C 4/46 297/27 |
| 8,905,471 | B2 * | 12/2014 | Tang | A47C 7/68 297/160 |
| 2002/0125745 | A1 | 9/2002 | Lee | |
| 2006/0138808 | A1 * | 6/2006 | Cui | A47C 1/035 297/30 |
| 2009/0072592 | A1 | 3/2009 | Zheng | |
| 2012/0286544 | A1 | 11/2012 | Cohen | |
| 2015/0313364 | A1 * | 11/2015 | Miller | A47C 4/04 297/19 |
| 2019/0269244 | A1 * | 9/2019 | Pernet | A47C 1/0355 |

* cited by examiner

Fig. 5
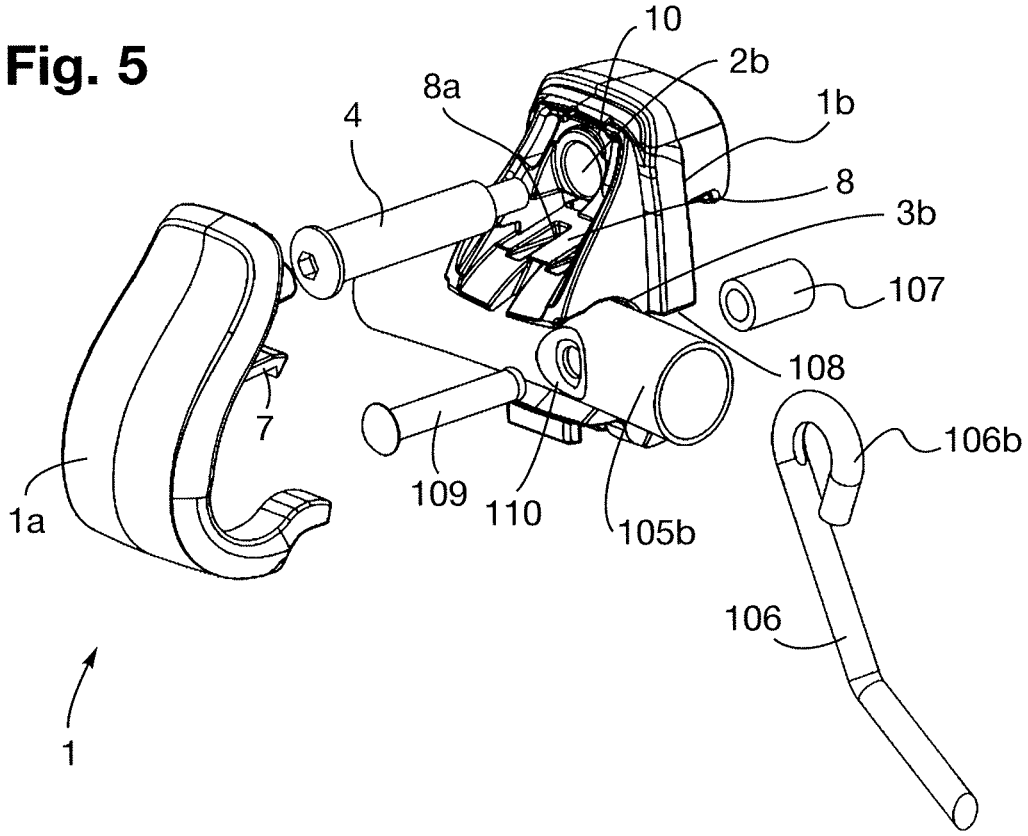
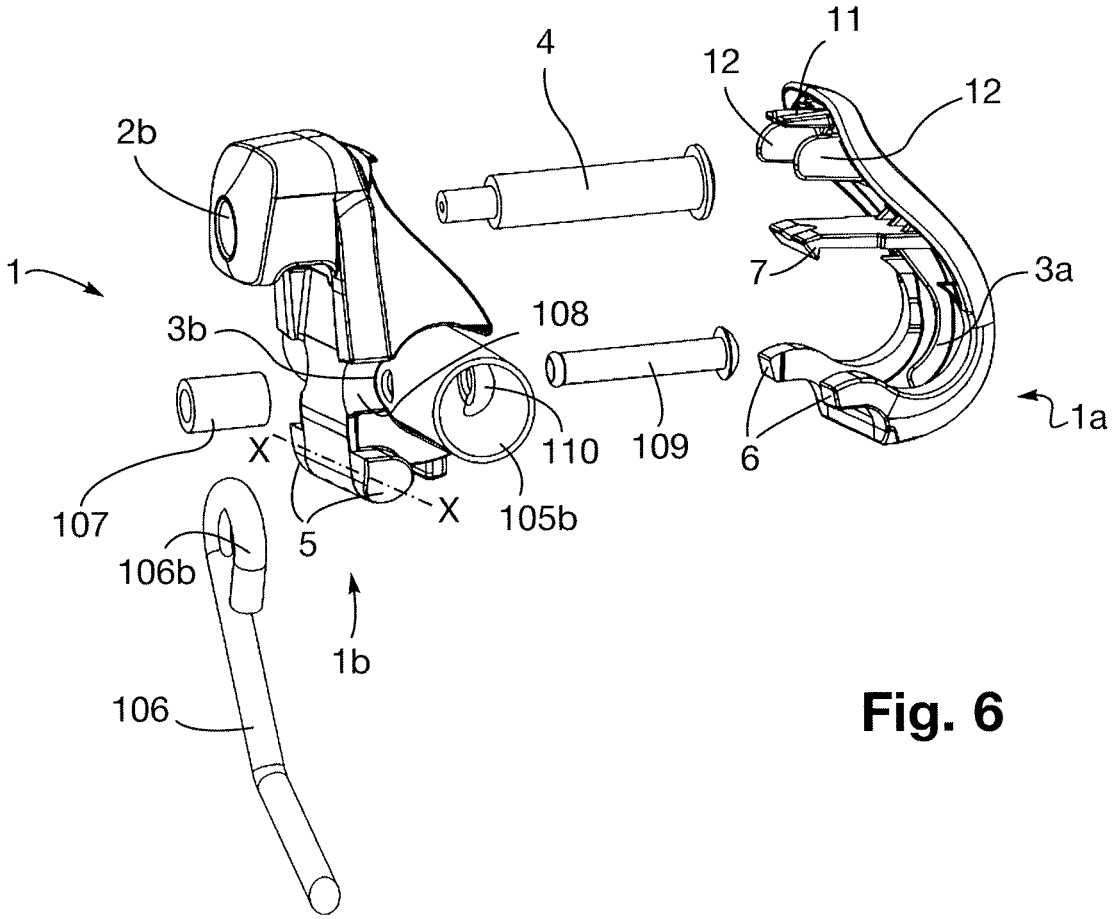
Fig. 6

Fig. 9
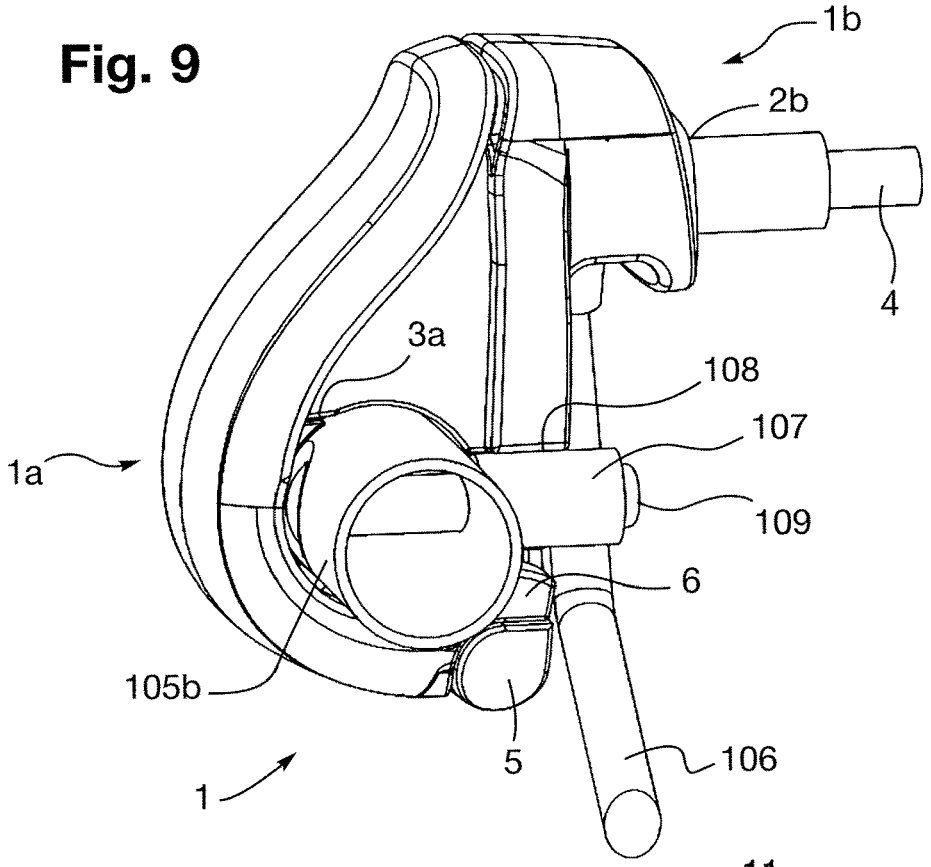
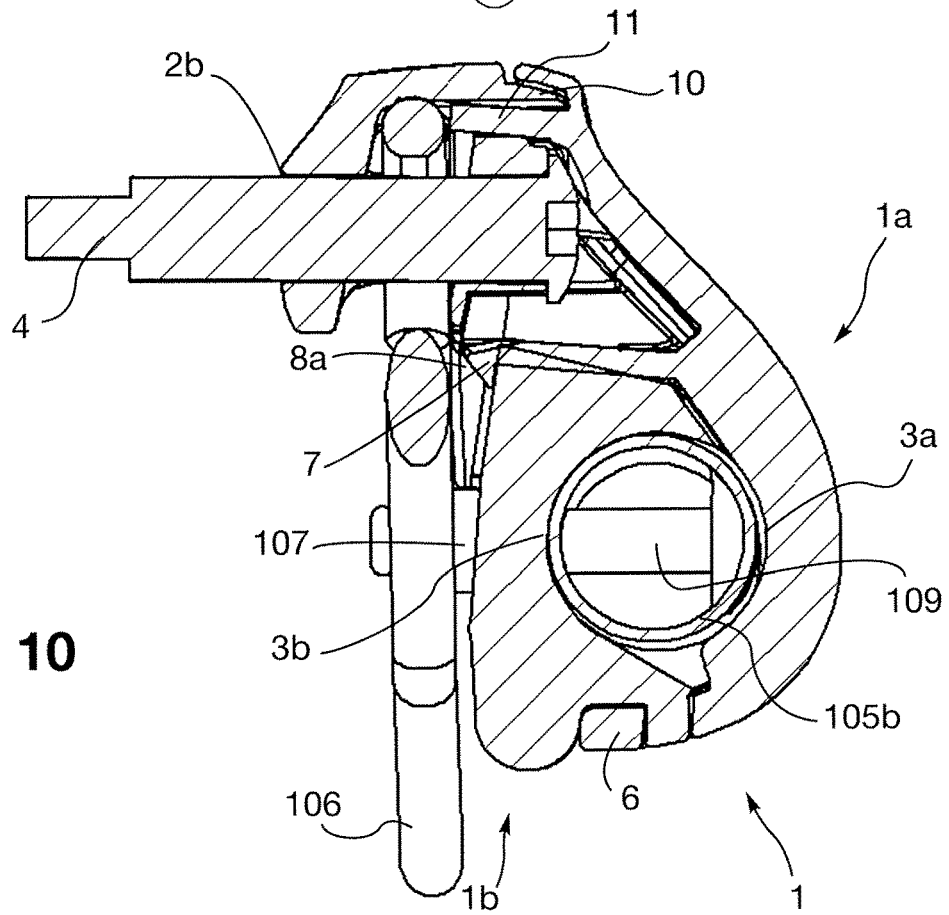
Fig. 10

Fig. 11
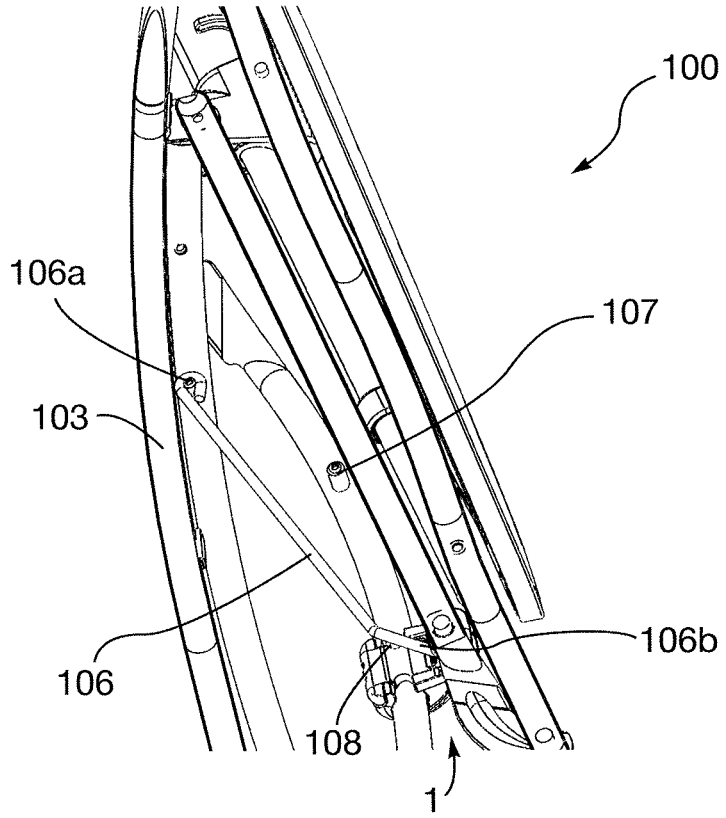
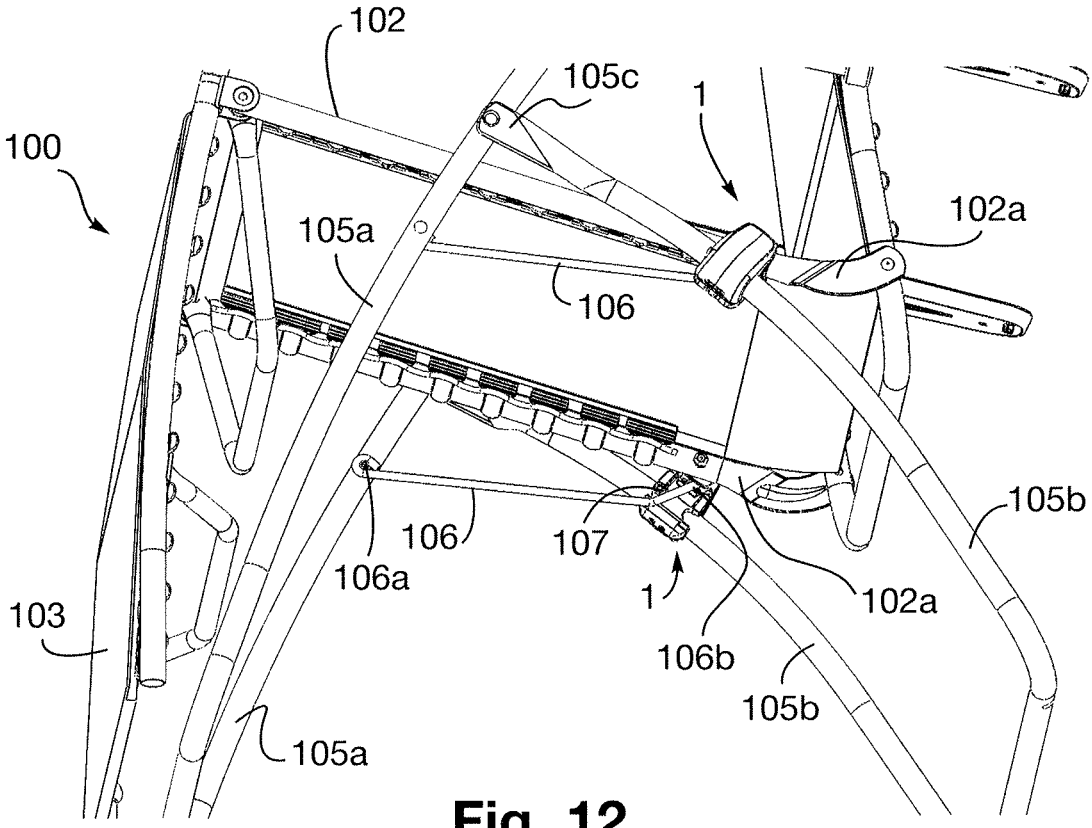
Fig. 12

RECLINABLE FOLDING DECKCHAIR

TECHNICAL FIELD

The present disclosure concerns the field of furniture and more specifically that of foldable and reclining armchairs or chairs comprising at least a backrest and a leg-rest.

BACKGROUND

An example of these armchairs is described in French patent FR2721811. This document describes a relax armchair comprising: a frame forming the backrest; two parallel beams forming the seat, the beams being hinged in the vicinity of the lower end of the backrest frame; two armrests parallel to each other and parallel to the beams of the seat, the armrests being hinged on the backrest frame, each armrest having a sliding axis parallel to the beams; a U-shaped frame forming the leg-rest whose two branches are hinged to the end of the beams, the upper end of the branches of the leg-rest frame is hinged at the end of the armrests; a stretched piece of fabric being hooked on the frame and to the beams by elastic means.

The armchair according to this document further comprises a stand formed by two jambs, a front jamb and a rear jamb respectively, each jamb being formed by parallel legs secured to the beams, said jambs being hinged together around a yoke, the end of each front jamb having a yoke adapted to slide on said sliding axis and a means for blocking position of the armchair, the legs of the jambs being connected together by a hinged connecting rod, respectively on the front jamb and on a yoke fastened on the rear end of the beam, adapted to enable the sliding of each rear jamb.

Thus, the transmission of movement between the backrest and the leg-rest is achieved by the deformation of the quadrilateral formed by the backrest, the leg-rest, the seat beams and the sliding axis of the armrest. During this movement, the entire stand is stationary, in particular the sliding yoke and the yoke located at the rear of the beam, so that the armrest is displaced at the same time as the backrest.

As described in this example, the yoke at the rear of the beam is secured to the seat beam and enables the sliding of the jamb relative to said beam. The drawback of this configuration is that this yoke is not totally satisfactory from an aesthetic point of view, in particular since the screw maintaining the yoke fastened is apparent and makes the overall appearance of the armchair less attractive.

BRIEF SUMMARY

The disclosure aims at overcoming all or part of the aforementioned drawbacks.

The disclosure provides a foldable and reclining armchair comprising at least:

- a backrest,
- a seat delimited by at least one first and one second beams positioned opposite each other, said seat being hinged relative to the backrest,
- a stand formed by a first jamb and a second jamb, each jamb being formed by at least one front leg and one rear leg, said rear leg comprising an end hingedly mounted on the front leg, each jamb of the stand comprising a jamb yoke including a first portion configured to enable sliding of the rear leg and a second portion fastened on a beam of the seat, said stand comprising on each jamb means for limiting the sliding of the rear leg, characterized in that the jamb yoke is formed by at least one receiving shell comprising a first receiving housing shaped so as to at least partially house a fastening member, the fastening member being intended to be fastened to a beam of the seat, and at least one covering shell, hinged relative to the receiving shell, said covering shell comprising on one face a cover configured to at least partially conceal the fastening member housed at least partially in the first receiving housing of the receiving shell.

Thanks to this configuration, the fastening of each jamb at the level of a seat beam is not visible, which allows improving the aesthetics of the armchair.

According to a feature of the disclosure, the covering shell further comprises a complementary first receiving housing shaped so as to at least partially receive the fastening member.

According to a feature of the disclosure, the complementary first receiving housing is preferably blind and is positioned on a face opposite to the cover of the covering shell. Thus, when the jamb yoke is closed, the fastening member is enclosed within the jamb yoke and is not shown.

According to a feature of the disclosure, the receiving shell comprises a second receiving housing shaped so as to at least partially house a portion of a rear leg of a jamb yoke is formed by at least one receiving shell comprising a first receiving, said second receiving housing enabling the mobility of the rear leg.

According to a feature of the disclosure, the covering shell comprises a complementary second receiving housing shaped so as to at least partially receive the rear leg housed at least partially in the second receiving housing of the receiving shell. Thus, when the jamb yoke is closed, the rear leg is enclosed within the jamb yoke while remaining free to slide.

According to a feature of the disclosure, the covering shell is rotatably mounted on the receiving shell.

According to a feature of the disclosure, the receiving shell comprises at least one pivot lug configured to cooperate with a complementary member formed on the covering shell.

Advantageously, the pivot lug extends projecting on either side of the receiving shell according to a transverse axis of the jamb yoke. Advantageously, the transverse axis in which the pivot lug extends is substantially parallel to the axis according to which a second receiving housing shaped so as to slidably receive the rear leg of a jamb, extends.

According to a feature of the disclosure, each pivot lug is positioned laterally with respect to the receiving shell.

According to a feature of the disclosure, the covering shell comprises at least one complementary member, preferably in the form of a tab intended to cooperate with the at least one pivot lug of the receiving shell. Advantageously, the covering shell comprises at least two tabs positioned opposite each other laterally with respect to the covering shell, each tab being intended to cooperate with a pivot lug projecting from the receiving shell.

According to a feature of the disclosure, the receiving shell and the covering shell are connected to each other by a connecting member, preferably a leaf spring.

According to a feature of the disclosure, the covering shell comprises a closure member of the jamb yoke, said closure member being configured to cooperate with a complementary closure member formed in the receiving shell.

According to a feature of the disclosure, the closure member is projecting with respect to the covering shell. Advantageously, the closure member extends along an axis secant, and preferably substantially perpendicular, to the longitudinal axis in which the jamb yoke extends.

According to a feature of the disclosure, the closure member has at a free end a retainer element shaped so as to cooperate with the complementary closure member.

According to another feature of the disclosure, the closure member has at a free end a retainer element shaped so as to cooperate with an orifice formed in the complementary closure member.

According to a feature of the disclosure, the complementary closure member is formed above the second housing of the receiving shell.

According to a feature of the disclosure, the complementary closure member comprises an orifice shaped so as to cooperate with the closure member of the covering shell.

According to another feature of the disclosure, the covering shell comprises at least one guide blade arranged in the vicinity of the complementary first receiving housing and being configured to cooperate with an indentation formed in the receiving shell.

Preferably, the covering shell comprises two guide blades positioned on either side of the complementary first receiving housing.

According to another feature of the disclosure, the covering shell comprises at least one retainer element shaped so as to cooperate with a complementary retainer element formed on the receiving shell.

According to a feature of the disclosure, the retainer element comprises a free end preferably having a hook-like shape.

According to a feature of the disclosure, the receiving shell comprises a complementary retainer element shaped so as to cooperate with a retainer element formed on the covering shell.

According to a feature of the disclosure, the complementary retainer element comprises a projecting portion, the shape of the free end of the retainer element being shaped so as to be engaged on said projecting portion of the complementary retainer element.

According to a feature of the disclosure, the sliding limitation means on each jamb comprise a connecting rod, having a first end hinged around the front leg and a second end hinged around the jamb yoke, and an element fastened in the rear leg and shaped so as to abut against the connecting rod in the vicinity of its second end. Preferably, the receiving shell comprises a receiving area shaped so as to receive the element forming the stop.

According to a feature of the disclosure, the armchair further comprises parallel armrests hinged on the backrest, each armrest having a sliding axis.

According to a feature of the disclosure, the armchair further comprises a leg-rest comprising two branches hinged relative to the seat and relative to the armrests.

According to a feature of the disclosure, the armchair further comprises a stretched piece of fabric intended to cover at least the backrest, and/or the seat and/or the leg-rest.

BRIEF DESCRIPTION OF THE DRAWINGS

The disclosure will be better understood, thanks to the following description, which relates to an embodiment according to the present disclosure, provided as a non-limiting example and explained with reference to the appended schematic drawings, in which:

FIG. 5 is an exploded perspective view on one side of the jamb yoke of the armchair according to the disclosure, FIG. 6 is an exploded perspective view on the other side of the jamb yoke of the armchair according to the disclosure, FIG. 9 is a perspective view substantially similar to FIG. 7 with the jamb yoke closed, FIG. 10 is a cross-sectional view substantially similar to FIG. 8 with the jamb yoke closed, FIG. 11 is a partial side view of the armchair according to the disclosure in the folded position, FIG. 12 is a partial bottom view of the armchair according to the disclosure in the unfolded sitting position.

DETAILED DESCRIPTION

Figure 1:
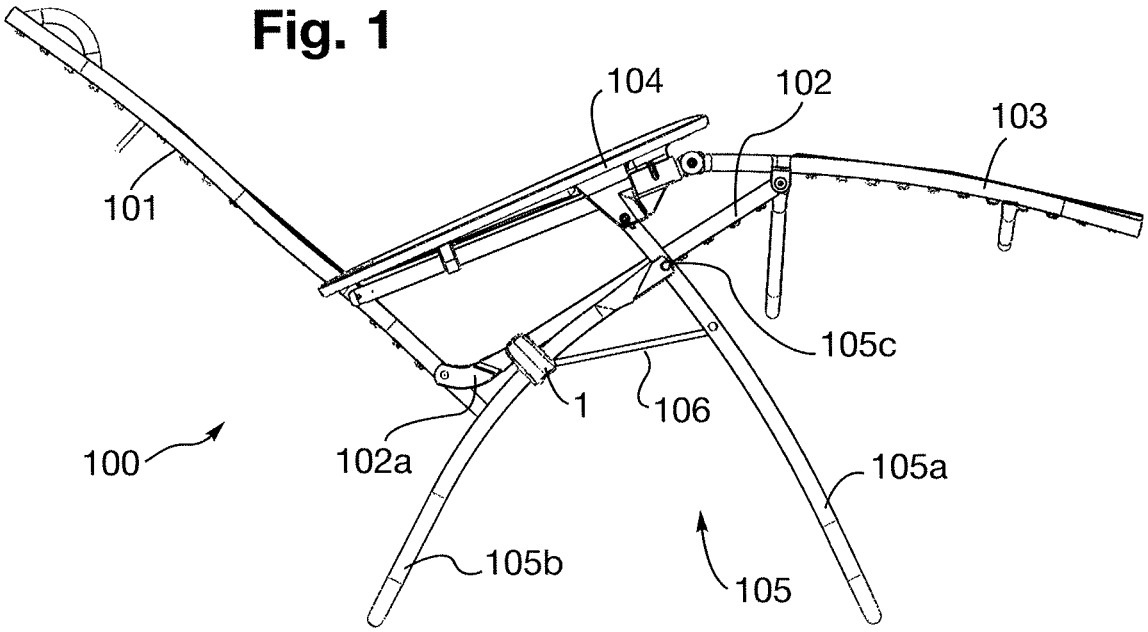
FIG. 1 is a side view of the armchair according to the disclosure in the unfolded elongated position.

An armchair 100 according to the disclosure is foldable and reclining. The armchair 100 comprises a backrest 101, a seat 102, a stand formed by a first jamb 105 and a second jamb 105, as illustrated in FIGS. 1 to 4.

Furthermore, the armchair according to the disclosure comprises parallel armrests 104 hinged on the backrest 101, each armrest 104 having a sliding axis; a leg-rest 103 comprising two branches hinged relative to the seat 102 and relative to the armrests 104; a stretched piece of fabric (not represented) intended to cover the backrest 101, the seat 102 and the leg-rest 103.

Figure 2:
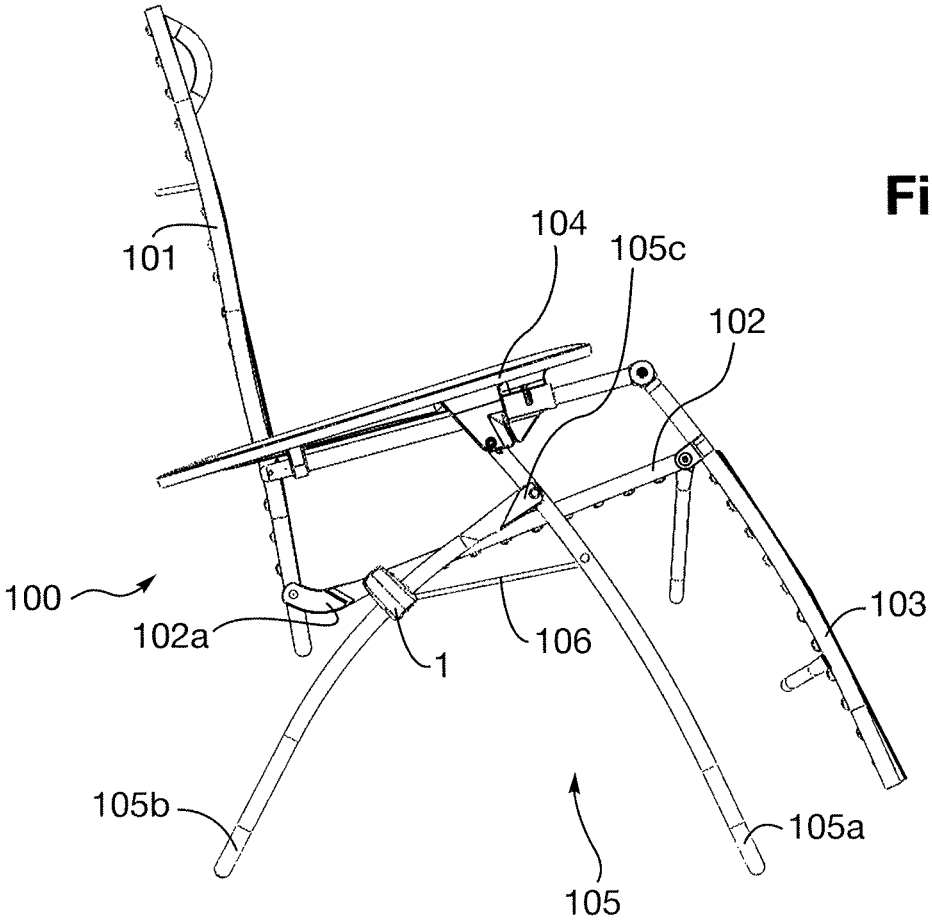
FIG. 2 is a side view of the armchair according to the disclosure in the unfolded sitting position.
Figure 3:
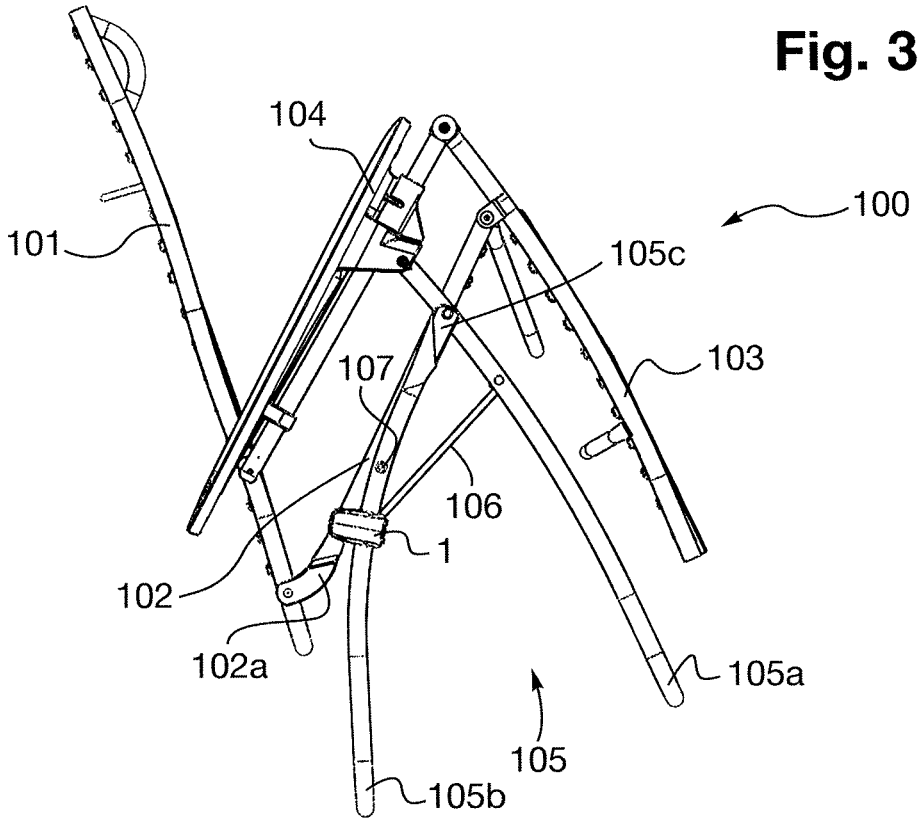
FIG. 3 is a side view of the armchair according to the disclosure in the folded intermediate position.
Figure 4:
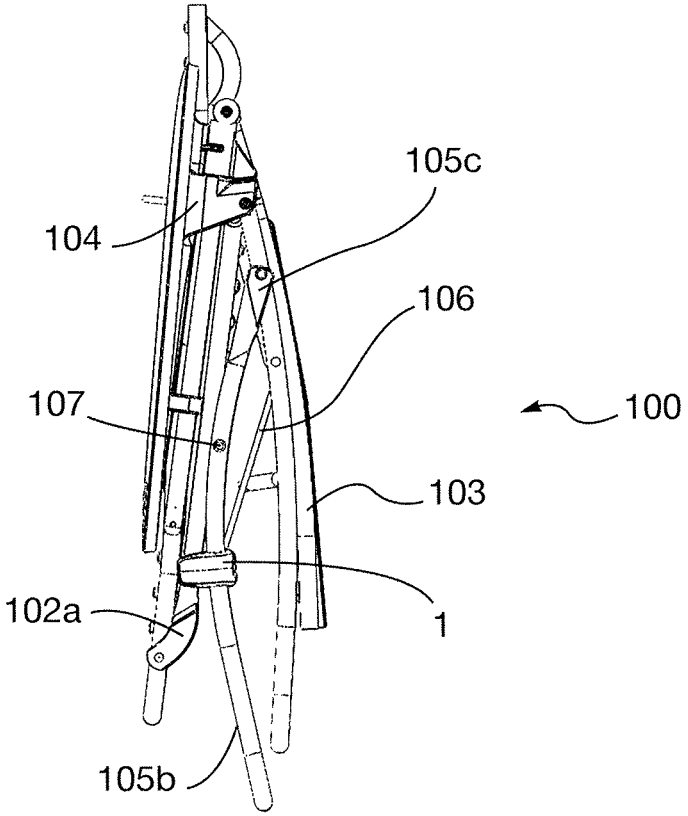
FIG. 4 is a side view of the armchair according to the disclosure in the folded position.

According to the disclosure, the seat 102 of the armchair 100 is delimited by at least one first and one second beams 102*a* positioned in parallel and opposite each other, said seat 102 being hinged relative to the backrest 101 as illustrated in FIGS. 1 and 2.

In the example illustrated in FIGS. 1 to 4, each jamb 105 is formed by at least one front leg 105*a* and one rear leg 105*b*. Each rear leg 105*b* of each jamb 105 comprises a planar end 105*c* hingedly mounted on a front leg 105*a* of the same jamb 105. Each jamb 105 of the stand comprises a jamb yoke 1 including a first portion configured to enable the sliding of the rear leg 105*b* and a second portion fastened to a beam 102*a* of the seat 102.

As illustrated in FIGS. 5 and 6, the jamb yoke 1 is formed by at least one receiving shell 1*b* comprising a receiving housing 2*b* of a fastening member 4 shaped so as to be fastened to a beam 102*a* of the seat 102, and at least one covering shell 1*a*, hinged relative to the receiving shell 1*b*.

The covering shell 1*a* comprises a cover configured to cover the fastening member 4 housed in the receiving housing 2*b* of the receiving shell 1*b* as shown in FIG. 5. The covering shell 1*a* further comprises a complementary receiving housing 2*a* shaped so as to at least partially receive the fastening member. The complementary receiving housing 2*a* is preferably blind and is positioned on a face opposite to the cover of the covering shell 1*a*, as illustrated in FIG. 6. Thus, when the jamb yoke is closed, as represented in FIG. 10, the fastening member 4 is enclosed within the jamb yoke 1.

Figure 7:
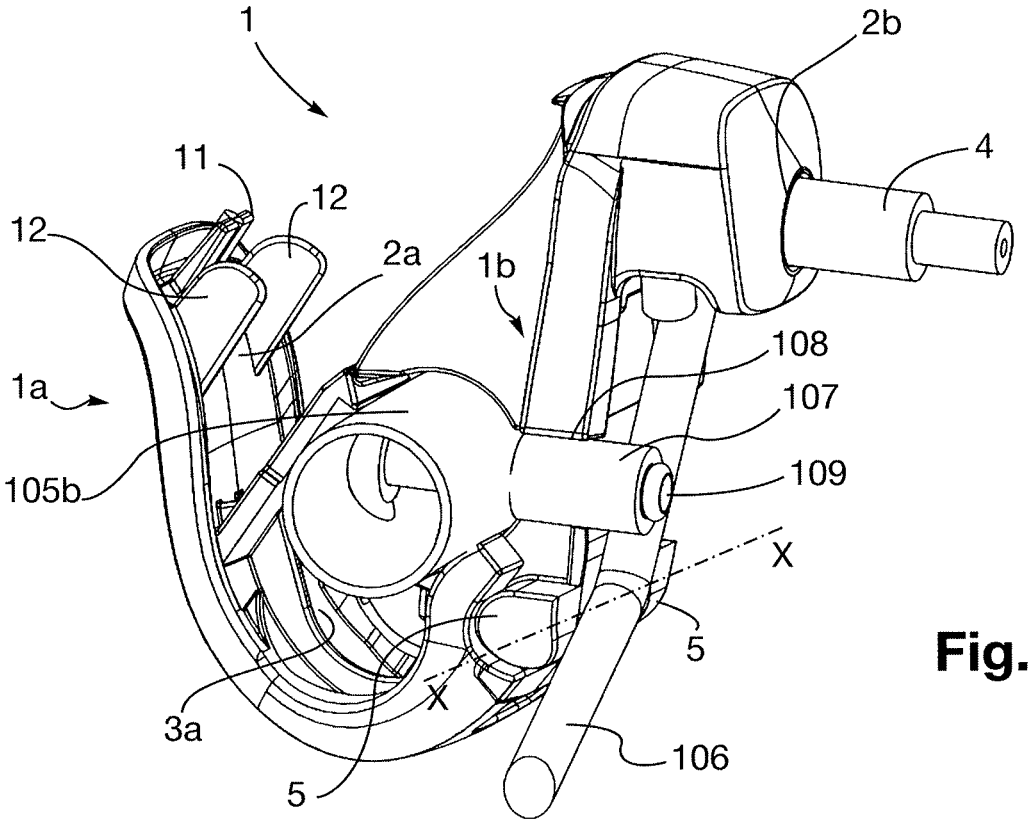
FIG. 7 is a perspective view on one side of the open jamb yoke.
Figure 8:
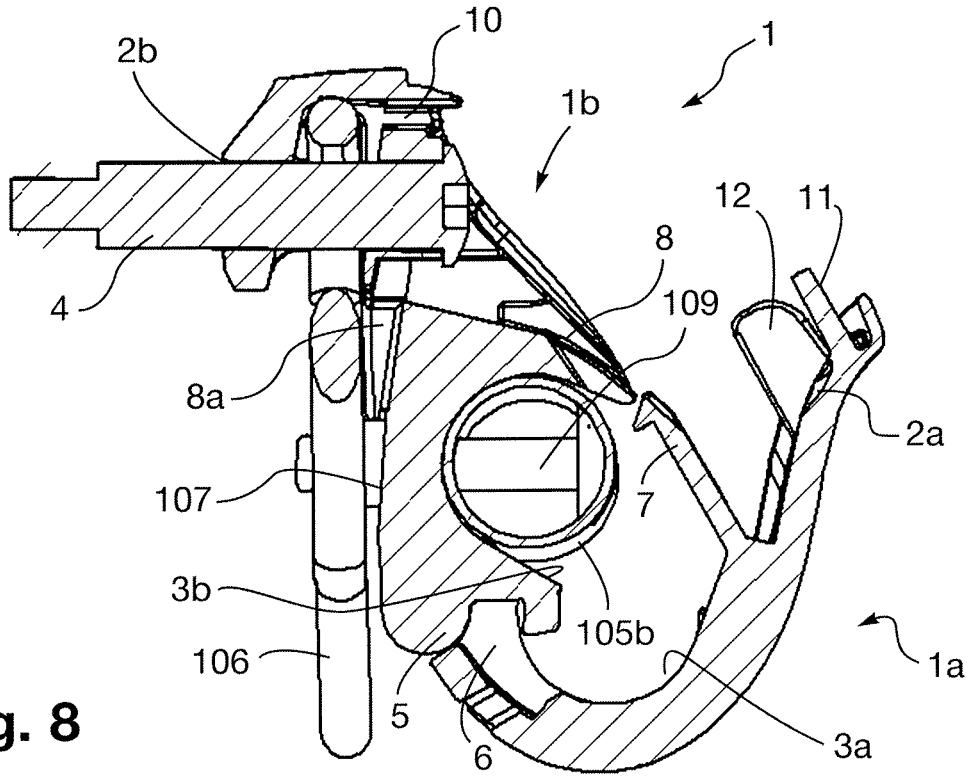
FIG. 8 is a cross-sectional view on the other side of the open jamb yoke.
Figure 13:
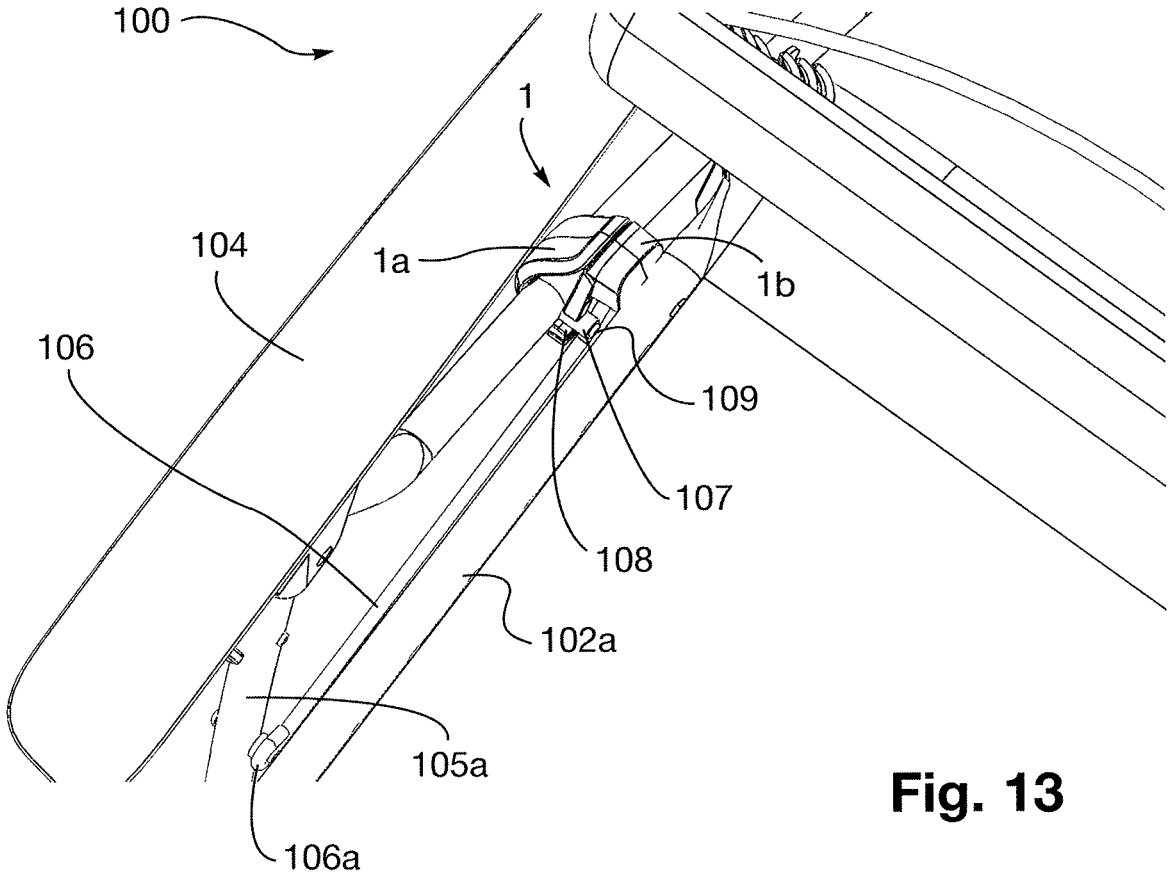
FIG. 13 is a detail view from the inside of the armchair according to the disclosure in the unfolded sitting position.

As shown in particular in FIGS. 7 and 8, the covering shell 1*a* is rotatably mounted about the axis X-X on the receiving shell 1*b*. Indeed, the receiving shell 1*b* comprises two pivot lugs 5 each intended to cooperate with a complementary member, in the form of a tab 6 formed on the covering shell 1*b*.

As illustrated in particular in FIG. 6, each pivot lug 5 extends projecting on either side of the receiving shell 1*b* according to a transverse axis X-X of the jamb yoke 1. Advantageously, the transverse axis X-X, according to which each pivot lug 5 extends, is substantially parallel to the axis according to which a second receiving housing 3*b*, shaped so as to slidably receive the rear leg 105*b* of a jamb 105, extends.

As shown in FIG. 6, the covering shell 1*a* comprises two complementary members 6 in the form of tabs 6 each shaped so as to cooperate with a pivot lug 5. The two tabs 6 are positioned opposite each other laterally with respect to the covering shell 1*a*.

In addition, the receiving shell 1*b* and the covering shell 1*a* may be connected to each other by a connecting member, preferably a leaf spring.

According to the disclosure, the receiving shell 1*b* further comprises a second receiving housing 3*b* shaped so as to slidably receive a rear leg 105*b* of the jamb 105, as represented in FIGS. 5 to 10. Advantageously, the covering shell 1*a* comprises a complementary second receiving housing 3*a* shaped so as to at least partially receive the rear leg 105*b* housed in the second receiving housing 3*b* of the receiving shell 1*b*. Thus, when the jamb yoke is closed, as represented in FIG. 10, the rear leg 105*b* is enclosed within the jamb yoke 1.

Advantageously, the covering shell 1*a* comprises a closure member 7 of the jamb yoke 1, said closure member 7 being configured to cooperate with a complementary closure member 8 formed in the receiving shell 1*b*, as illustrated in particular in FIGS. 8 and 10.

The closure member 7 is projecting with respect to the covering shell 1*a* and more particularly extends according to an axis secant, and preferably substantially perpendicular, to the longitudinal axis according to which the jamb yoke 1 extends, as shown in FIG. 10. The closure member 7 has at a free end a retainer element shaped so as to cooperate with the complementary closure member 8, and more specifically with an orifice 8*a* formed in the complementary closure member 8.

The complementary closure member 8 is formed above the second housing 3*b* of the receiving shell 1*b* as shown in FIGS. 8 and 10. The complementary closure member 8 comprises an orifice 8*a* shaped so as to cooperate with the closure member 7 of the covering shell 1*a*.

As illustrated in FIG. 6, the covering shell 1*a* further comprises two guide blades 12 arranged on either side of the complementary first receiving housing 2*a*. The two guide blades 12 being intended to cooperate with a indentation formed in the receiving shell 1*b*. Of course, these guide blades are optional and may be more or less than two in number.

Furthermore, in the example illustrated in particular in FIG. 7, the covering shell 1*a* comprises a retainer element 11 shaped so as to cooperate with a complementary retainer element 10 formed on the receiving shell 1*b*. The retainer element 11 comprises a free end preferably having a hook-like shape as shown in FIG. 7.

The receiving shell 1*b* comprises a complementary retainer element 10 shaped so as to cooperate with a retainer element 11 formed on the covering shell 1*a*. The complementary retainer element 10 comprises a projecting portion, the shape of the free end of the retainer element 11 is shaped so as to be engaged on said projecting portion of the complementary retainer element 10, as illustrated in FIG. 10.

As shown in all of FIGS. 5 to 10, the covering shell 1*a* has a face constituted by the cover and an opposite face comprising all the components described hereinabove and each intended to cooperate with a complementary component of the receiving shell 1*b*.

Moreover, on each jamb 105, the armchair 100 comprises means for limiting the sliding of the rear leg 105*b* made using a connecting rod 106 and an element 107 forming a stop.

The connecting rod 106 has a first end 106*a* hinged around the front leg 105*a* and a second end 106*b* hinged around the jamb yoke 1. More specifically, the first end 106*a* is bent around a fastening element passing through the front leg 105*a*, as represented in particular in FIG. 12, and the second end 106*b* is bent around the fastening member 4 so as to be housed in the jamb yoke 1, as represented in FIG. 7.

The element 107 forming a stop is fastened in the rear leg 105*b* using a fastening rod 109 passing through orifices 110 carried by said rear leg 105*b*.

During the deployment of the armchair 100, each rear leg 105*b* will slide backwards until the element 107 abuts against an area of the connecting rod 106 located in the vicinity of its second end 106*a*. The armchair 100 is then stabilized and enables the seating of a person.

The receiving shell 1*b* advantageously has a concave receiving area 108 shaped so as to receive the element 107 when it comes into contact with the connecting rod 106. Thus, this allows avoiding the concentration of the forces exerted by the element 107 on the sole connecting rod 106 and distributing them between the jamb yoke 1 and said connecting rod 106, safety and stability being thereby increased.

Of course, the disclosure is not limited to the embodiment described and represented in the appended figures. Modifications are still possible, in particular with regards to the constitution of the various elements or by substitution of technical equivalents, yet without departing from the scope of the disclosure.

The invention claimed is:

1. A foldable and reclining armchair comprising at least:

a backrest, a seat delimited by at least one first and one second beams positioned opposite each other, said seat being hinged relative to the backrest, a stand, formed by a first jamb and a second jamb, each jamb being formed by at least one front leg and one rear leg, said rear leg comprising an end hingedly mounted on the front leg, each jamb of the stand comprising a jamb yoke including a first portion configured to enable sliding of the rear leg and a second portion fastened on a beam of the seat, said stand comprising on each jamb means for limiting the sliding of the rear leg, wherein the jamb yoke is formed by at least one receiving shell comprising a first receiving housing shaped so as to at least partially house a fastening member, the fastening member being intended to be fastened to a beam of the seat, and at least one covering shell, hinged relative to the receiving shell, said covering shell comprising on one face, a cover configured to at least partially conceal the fastening member housed at least partially in the first receiving housing of the receiving shell.

2. The armchair according to claim 1, wherein the covering shell further comprises a complementary first receiving housing shaped so as to at least partially receive the fastening member.

3. The armchair according to claim 2, wherein the complementary first receiving housing is positioned on a face opposite to the cover of the covering shell.

4. The armchair according to claims 1, wherein the receiving shell comprises a second receiving housing shaped so as to at least partially house a portion of a rear leg of a jamb, said second receiving housing enabling the mobility of the rear leg.

5. The armchair according to claim 4, wherein the covering shell comprises a complementary second receiving housing shaped so as to at least partially receive the rear leg housed at least partially in the second receiving housing of the receiving shell.

6. The armchair according to claim 1, wherein the covering shell is rotatably mounted on the receiving shell.

7. The armchair according to any one of claim 1, wherein the receiving shell comprises at least one pivot lug configured to cooperate with a complementary member formed on the covering shell.

8. The armchair according to claim 7, wherein the covering shell comprises at least one complementary member intended to cooperate with the at least one pivot lug of the receiving shell.

9. The armchair according to claim 1, wherein the covering shell comprises a closure member of the jamb yoke, said closure member being configured to cooperate with a complementary closure member formed in the receiving shell.

10. The armchair according to claim 1, wherein the sliding limitation means on each jamb comprise a connecting rod (106), having a first end hinged around the front leg and a second end hinged around the jamb yoke, and a fixed element in the rear leg and shaped so as to abut against the connecting rod in the vicinity of its second end.

11. The armchair of claim 10, wherein the receiving shell comprises a receiving area shaped so as to receive the element.

* * * * *